US007487989B2

(12) United States Patent
Crosby, II

(10) Patent No.: US 7,487,989 B2
(45) Date of Patent: Feb. 10, 2009

(54) WHEELCHAIR WITH RETRACTABLE STORING LEG RESTS

(75) Inventor: Gary Edward Crosby, II, Kalamazoo, MI (US)

(73) Assignees: Gary E. Crosby, II; Chery Y Crosby

( * ) Notice: Subject to any disclaimer, the term of this patent is extended or adjusted under 35 U.S.C. 154(b) by 343 days.

(21) Appl. No.: 11/294,202

(22) Filed: Dec. 6, 2005

(65) Prior Publication Data

US 2007/0126202 A1 Jun. 7, 2007

(51) Int. Cl.
*A61G 5/12* (2006.01)

(52) U.S. Cl. ..... 280/304.1; 280/250.1; 297/423.19; 297/423.22; 297/423.25

(58) Field of Classification Search ..... 280/304.1, 280/250.1, 291, 642, 643, 644, 647, 648, 280/649, 650, 657, 658, 47.25, 47.38, 47.4, 280/47.41, 79.2, DIG. 10; 297/423.19, 423.2, 297/423.3, 145, 423.22, 423.25, 423.28, 297/423.5; D03/200; D12/131
See application file for complete search history.

(56) References Cited

U.S. PATENT DOCUMENTS

| | | | | | |
|---|---|---|---|---|---|
| 694,538 | A * | 3/1902 | Eddy | 297/423.22 |
| 4,593,929 | A * | 6/1986 | Williams | 280/650 |
| 5,145,197 | A * | 9/1992 | Gatti | 280/304.1 |
| 5,378,041 | A * | 1/1995 | Lee | 297/391 |
| 6,352,307 | B1 * | 3/2002 | Engman | 297/284.11 |
| 6,773,073 | B1 * | 8/2004 | Escobedo | 297/423.34 |
| 7,144,025 | B2 * | 12/2006 | Wakita et al. | 280/250.1 |
| 7,331,632 | B2 * | 2/2008 | Wendt | 297/423.19 |
| 2005/0116440 | A1 * | 6/2005 | Bernatsky et al. | 280/250.1 |

* cited by examiner

*Primary Examiner*—Christopher Ellis
*Assistant Examiner*—Joseph Rocca

(57) ABSTRACT

A wheelchair which facilitates the storage of retractable leg rests within its side frames. These leg rest are independently able to be in the "stored" or "use" positions and continue to allow the wheelchair frame to be folded. The leg rest members are telescopically mounted to each other and allow for leg length adjustment on this telescopic slide. This leg rest assembly has angle adjustability to suit multiple angles of the occupant's knees for comfort.

5 Claims, 4 Drawing Sheets

WHEELCHAIR WITH RETRACTABLE STORING LEG RESTS

CROSS REFERENCE TO RELATED APPLICATION

I claim benefit from the provisional patent field Nov. 29, 2004. No. 60/631,271. This provisional patent reveals the nature of a wheelchair side frame with a cavity that allows storage space for an attached retractable leg rest assembly, while maintaining the folding capabilities of the frame.

STATEMENT REGARDING FEDERALLY SPONSORED RESEARCH OR DEVELOPMENT

Not Applicable.

BACKGROUND OF THE INVENTION

1. Field of the Invention

This invention lies in the field of wheelchairs and more specifically the storage of leg rest assemblies associated with said wheelchairs.

2. Description of Prior Art

The majority of prior art wheelchairs provide no storage capabilities for the associated leg rest assemblies, or allow for storage areas at the cost of being able to horizontally fold the wheelchair frame. The leg rests for these chairs must be completely removed from the wheelchair during patient transfers or transportation of the wheelchair. These removable leg rests are then easily lost or difficult for the wheelchair user to replace on the wheelchair frame. The prior art leg rest typically must be swung out to the side of the chair for removal or to make room for patient transfers. In tight quarters, as in a bathroom, there is no room for the leg rest to be swung out and removed, and therefore place users at risk for falling over the leg rest assemblies. The prior art leg rest are supported on hangers which have been proven to cause injury to wheelchair users. The prior art wheelchair frames that do allow folding, and have storage space, are impractical in that the leg rests are stored directly under the seat or the wheelchair user. This requires the user to fully lift his or her legs to make room to slide the leg rests into the storage area.

BRIEF SUMMARY OF THE INVENTION

This application is seeking a patent for a wheelchair which has retractable storing leg rest, that store within the width of the side frame of the wheelchair. The width of the side frame is further defined as the area between the exterior aspect of the rear wheel and the medial aspect of the upper portion of the cross brace (also known as the seat rail). This design will allow the leg rests to be moved into the storage/use positions, by the wheelchair user or care giver with minimal effort and without requiring the user to move his or her leg out of the plane of motion that the leg rest will travel on for storage. The design also allows the leg rests to be kept with the wheelchair at all times, to prevent loss or multiple trips from the car to the house during transportation. The design has space made in the side frame for storage of the leg rest via a track system, which enable the wheelchair to maintain its ability to fold, while maintaining a proper ergonomic alignment with the wheelchair users knee joint. In large health facilities there are multiple brands of wheelchairs with multiple styles of leg rests, these are not interchangeable. In these facilities the retractable leg rests will save time for the care givers and make the users safer. Safer by having leg rests available when dependant users are pushed by care givers and having legs safely out of harms way.

This wheelchair frame may be made out of square and/or tubular metal stock as required by the differential load placed on the frame dependant upon the weight of the wheelchair user. The testing limitations are specified by the guidelines set by the U.S. FDA.

Non-frame components will be made of a combination of metal, plastic and rubber.

BRIEF DESCRIPTION OF THE SEVERAL VIEWS OF THE DRAWING

Figure One shows the wheelchair frame assembled. The components portrayed are: 100 back upright, 230 seating surface, 220 seat rail, 150 opening in side frame for leg rest storage, 190 bottom frame rail, 180 mounting surface for front caster, 20 leg rest upper segment, 90 leg rest lower segment, 260 footplate, 160 front frame support, 110 rear wheel mounting surface, 250 arm rest, 240 back, and 5 the track system.

DETAILED DESCRIPTION OF THE INVENTION

Figure 1:
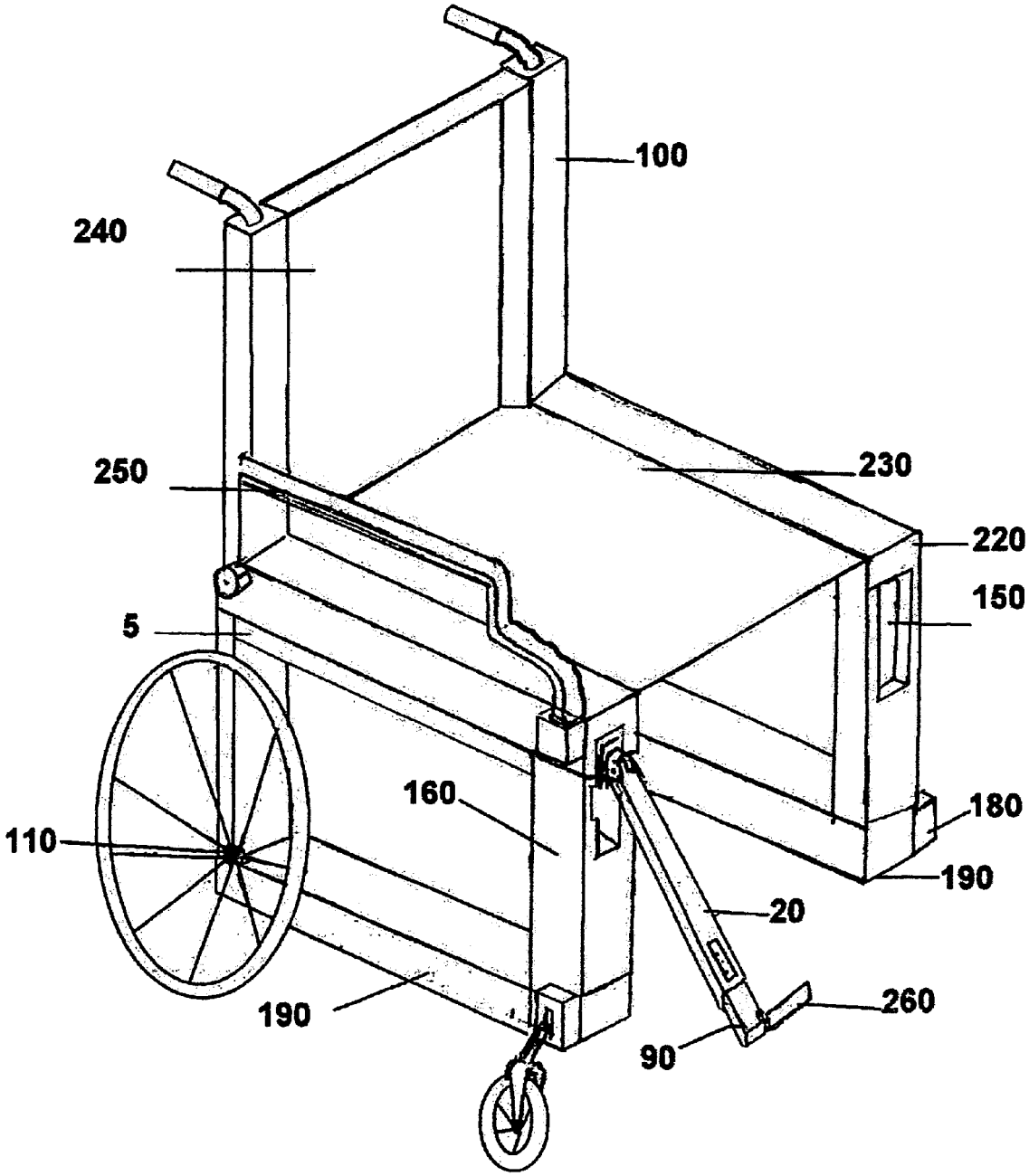
Figure 2:
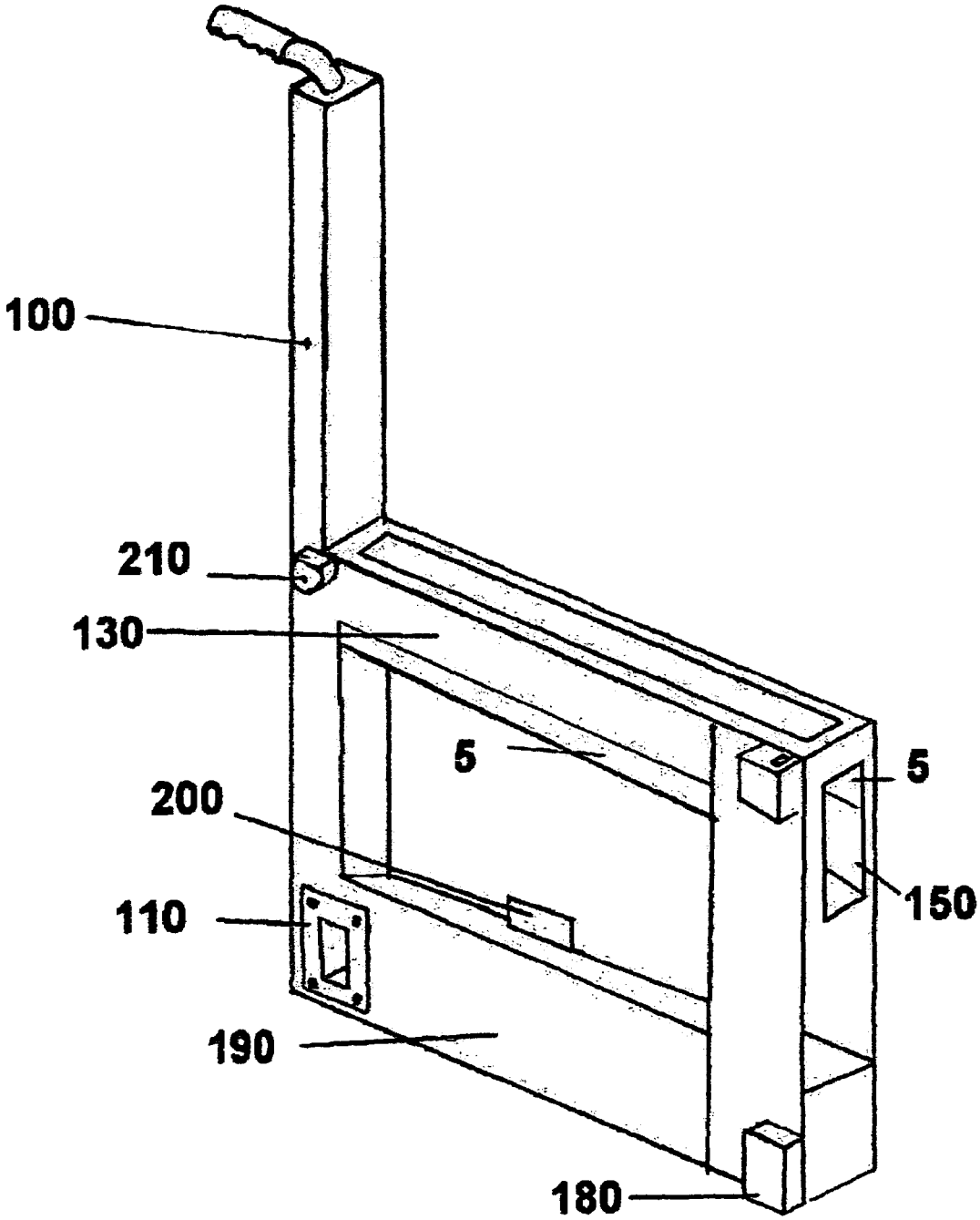
FIG. 2 portrays an individual side frame and components: 100 back upright, 210 arm rest attaching surface, 130 upper frame rail, 200 brake attaching surface, 110 rear wheel attaching surface, 190 bottom frame rail, 180 front caster attaching surface, 150 opening for leg rest storage which contains 5 the leg rest track system.
Figure 3:
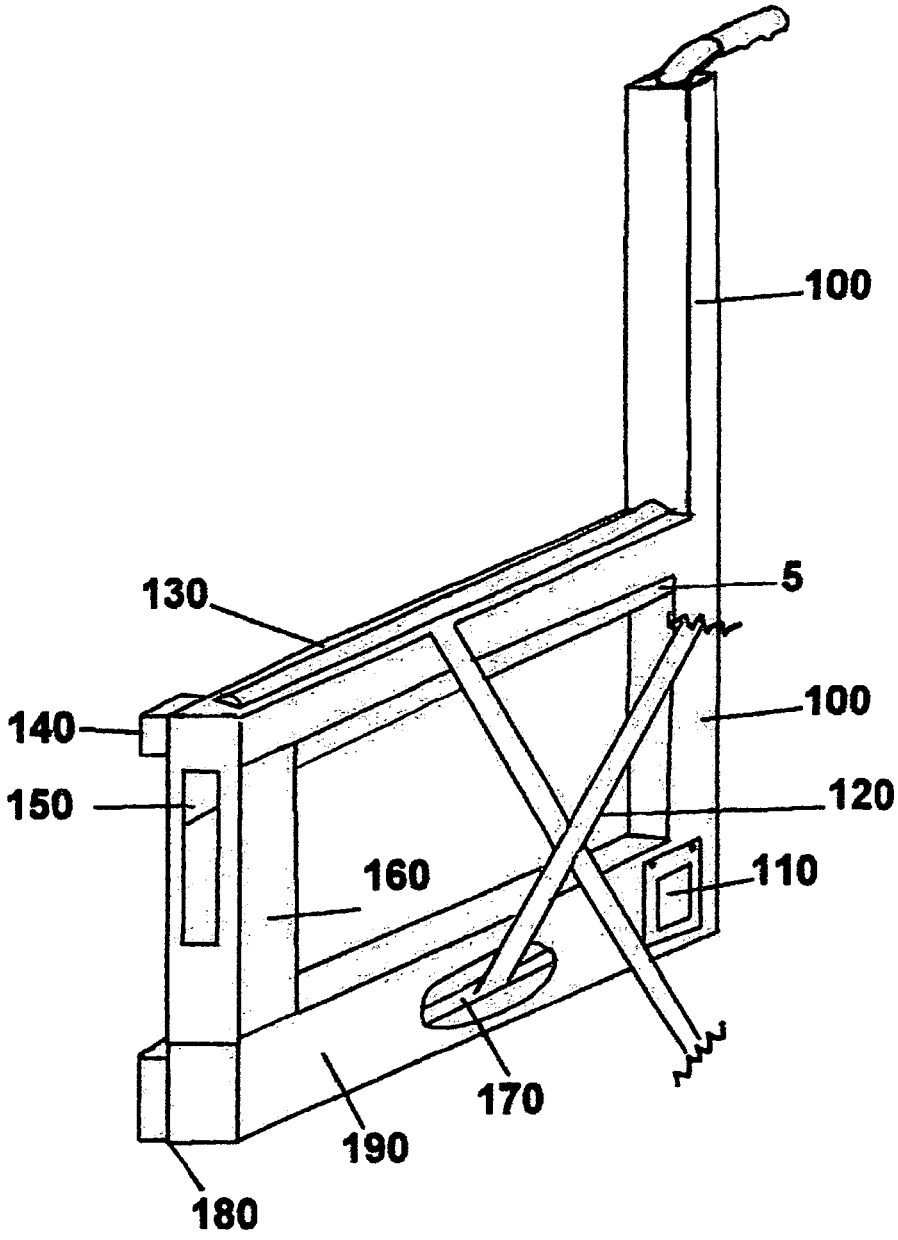
FIG. 3 portrays the medial aspect of a side frame. This figure includes a view of 170 the cross-brace which connects the two side frames of the wheelchair and allows it to fold.
Figure 4:
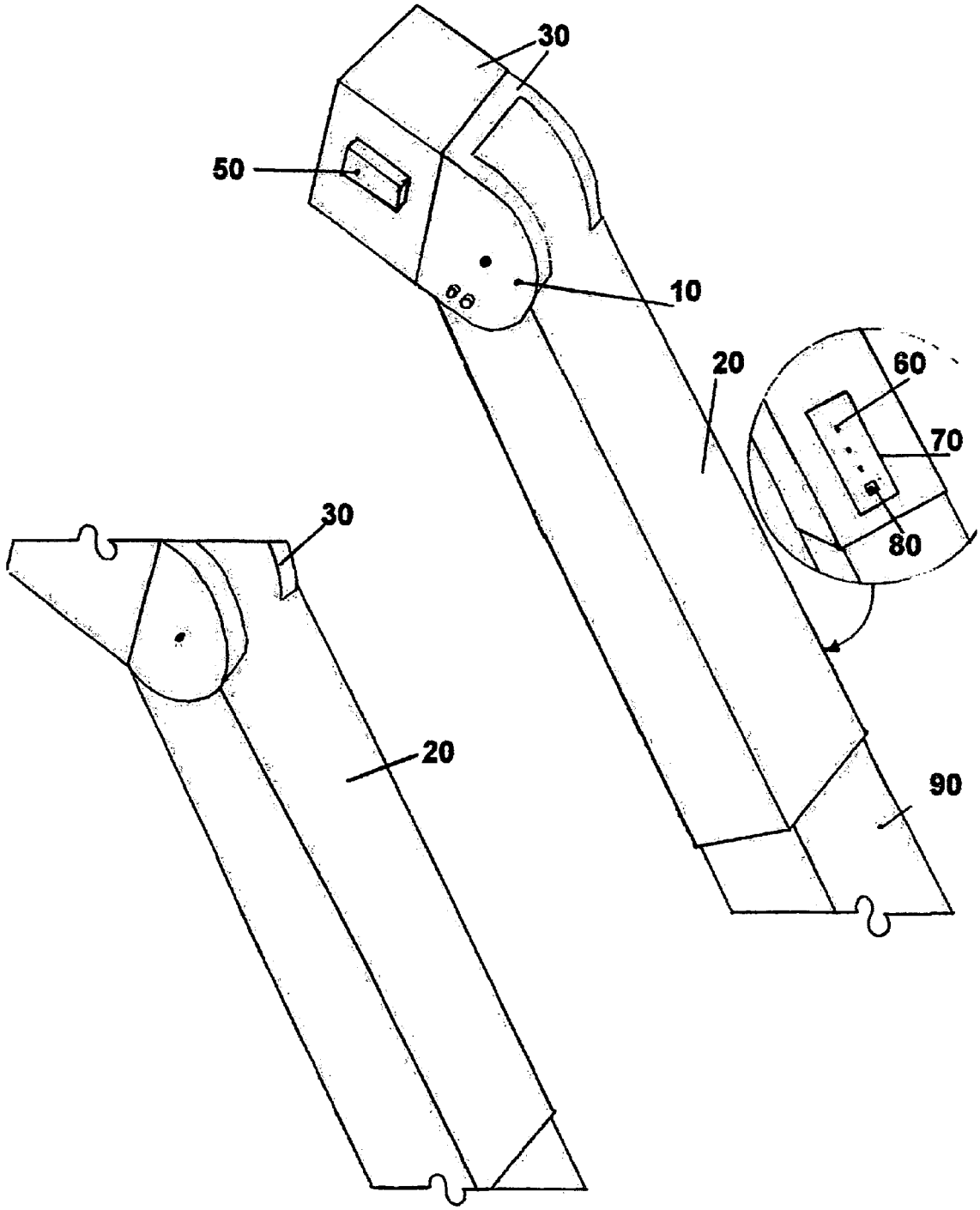
FIG. 4 shows a close up of the leg rest assembly. This figure reveals components: 30 the superior articulating end of the upper leg rest segment, which will articulate with the track system, 10 the positional locking joint of the upper leg rest segment, 30 the lower leg rest segment, 60 the locking mechanism for the telescopic leg rest assembly, 70 the reinforced side wall of the telescopic mechanism, 80 the movable stops for the telescopic assembly to stop the leg rest from extending too far, and 50 which is the stop that prevents the leg rest assembly from coming off the chair.

This invention pertains to the art of wheelchairs and more particularly to the leg rest and side frame of said wheelchair. The wheelchair consists of two side frames, defined as the area between the medial aspect of the seat rail (upper horizontal cross brace member) and the exterior aspect of the rear wheel, a seating surface, a back surface, two large rear wheels, two front caster wheels, two rear wheel brakes, two leg rest assemblies, a foldable cross brace which attaches said sides. Each side frame consists of a bottom frame rail, a top frame rail, a back upright, a medial front support, a lateral front support, a mounting surface for the bottom of the foldable cross-brace on the bottom frame rail, a mounting surface for a rear wheel brake, a mounting surface for a rear wheel and a front caster. Each side frame also contains an area which allows for storage of the leg rest assembly responding to that particular side of the frame, via a track system. This side frame space has a track system which ensures that the leg rest assembly can be retracted into the side frame for storage or extended for use. Each leg rest contains an upper segment and lower segment with a foldable footplate at its distal end. The leg rest assembly is a telescopic system which allows the leg rest to fully fit into the side frame opening. The leg rest footplate will also fold to allow it to fit within the side frame.

The leg rest assemblies superior attachment to the slide track has angle adjustability in regards to the user's knees to support the user's leg in multiple angles.

The invention claimed is:

1. A wheelchair comprising:

first and second leg rest assemblies;

first and second space apart sides;

a seat and back extending between said first and second spaced apart sides;

said first spaced apart side comprising a first side frame and said second spaced apart side comprising a second side frame, said first and second side frames each having an upper seat rail and an opening in said side frames for storage of said first and second leg rest assemblies, said openings comprising first and second side frame storage areas;

said first and second side frame storage areas, specifically designed for the storage of said first and second leg rest assemblies;

said first and second side frame storage areas being located in the area defined between the upper aspect of the upper seat rail and the exterior aspect of the rear tire, on the respective sides, said first leg rest assembly being movably mounted in said first side frame storage area;

said second leg rest assembly being movably mounted in said second side frame storage area, said first and second leg rest assemblies being independently fully retractable into said respective first and second side frame storage areas, for storage and are independently extendable from said respective first and second storage areas for use by an occupant of the wheelchair, said first and second side frames further comprising attachment surfaces for rear wheels; front casters; rear wheel brakes; and arm rests.

2. The wheelchair according to claim 1, wherein the first and second said frame storage areas allow for the wheelchair to be folded horizontally with either the leg rests retracted for storage or extended for occupant use.

3. The wheelchair according to claim 1, wherein each of the leg rest assemblies includes a base member, an upper leg rest portion and a lower leg rest portion, said upper leg rest portion being pivotally mounted to said base member, said lower leg rest portion being mounted to said upper leg rest portion, said base members being movably mounted in one of said first or second side frame storage areas, and assembled in a manner to allow folding of the foot plate and retracting of each individual leg rest independently for storage purposes entirely within each side frame.

4. The wheelchair according to claim 3, wherein said base member of each side's leg rest assemblies, is movably mounted in the respective side frame storage areas on a rail/track system which attaches to an end of each side's leg rest assembly.

5. The wheelchair according to claim 3, wherein said lower leg rest portion is built to be at least partially retracted into the upper leg rest portion for storage, said leg rest portions further comprising a changeable stop portion.

* * * * *